United States Patent [19]

Hall

[11] Patent Number: 4,682,482

[45] Date of Patent: Jul. 28, 1987

[54] DEADBOLT LOCK

[76] Inventor: Marvin Z. Hall, 4535 E. Prieto Rd., Altadena, Calif. 91001

[21] Appl. No.: 850,957

[22] Filed: Apr. 11, 1986

[51] Int. Cl.[4] ..... E05B 65/06

[52] U.S. Cl. ..... 70/129; 292/153

[58] Field of Search ..... 70/129, 133, 134; 292/153, 145, 147, 181, 304

[56] References Cited

U.S. PATENT DOCUMENTS

| | | | |
|---|---|---|---|
| 87,907 | 3/1869 | Brumbach | 292/153 |
| 743,355 | 11/1903 | Walbridge | 70/129 |
| 2,468,406 | 4/1949 | Mora | 70/129 |
| 2,547,315 | 4/1951 | Gray | 292/153 |
| 4,272,974 | 6/1981 | Hennessy . | |
| 4,321,810 | 3/1982 | Wildenradt . | |
| 4,422,677 | 12/1983 | Gater . | |

FOREIGN PATENT DOCUMENTS

| | | | |
|---|---|---|---|
| 506340 | 5/1920 | France | 70/129 |
| 456912 | 4/1950 | Italy | 70/129 |

OTHER PUBLICATIONS

Flyer: "The Medeco D-11", Security Locks, Inc., Salem, Virginia (Undated).

"The 2-inch Alternative" brochure, Securitech Group, Inc., Maspeth, N.Y. (Undated).

*Primary Examiner*—Robert L. Wolfe

*Attorney, Agent, or Firm*—Sheldon & Mak

[57] ABSTRACT

A deadbolt lock mechanism for a door comprises an elongated bolt, means for guiding the bolt in the door between extended and retracted positions, a spindle unit having a cam for selectively engaging a transverse arcuate depression in the bolt for securing the bolt in the extended position, and a handle for moving the bolt between the extended and retracted positions. The bolt can be six inches long and capable of a stroke of two inches for engaging a stud supporting a frame for the door. The spindle unit can include a lock cylinder of conventional construction at one side of the door, and a thumbturn at the opposite side of the door, and other similar combinations. The mechanism can replace existing hardware at a standard backset distance of two and three eighths inches.

20 Claims, 6 Drawing Figures

DEADBOLT LOCK

BACKGROUND

This invention relates to deadbolt hardware, and more particularly to a deadbolt lock mechanism for residential and commercial buildings.

In a conventional deadbolt lock mechanism, an oscillating crank actuates a bolt which is selectively engaged with a strike plate on a door frame within which the door is closed. The crank is provided with a thumbturn or a lock cylinder at one side of the door for operating the bolt. In other configurations, a pair of lock cylinders, or a lock cylinder and a thumbturn are provided on opposite sides of the door.

In each of these configurations, the crank pivots on an axis intersecting the bolt, typically at a standard "backset" of two and three-eighths inch from an edge of the door, as in a conventional door latch mechanism. Conventionally, the bolt slides in a faceplate guide assembly that is installed in a clearance hole of about one inch diameter that interacts a larger, transn diameter) for the lock cylinder and/or thumbturn.

A disadvantage of the conventional deadbolt lock mechanisms of the prior art is that both the length of the bolt and its stroke is restricted, impairing the structural integrity of the door in the locked condition. The crank, operating within the standard three-quarter or seven-eighths inch cross-sectional height of the bolt, produces a stroke limited to about one inch. Moreover, the bolt is limited to a solid length of only about two inches because of interference with the crank and associated hardware. Thus the locked security of the door is impaired for at least some of the following reasons:

1. The striker can easily be torn out of the door frame by the bolt when an intruder drives against the door.
2. The door frame can be pried apart from the door, disengaging the bolt from the striker.
3. The stroke of the bolt is insufficient for engagement with solid structure such as a stud behind the door frame.
4. The bolt can be torn out of the door because the bolt is supported only within the portion of the door between the crank actuator and the edge of the door.

Thus there is a need for a deadbolt lock mechanism that has a long stroke for engaging solid structure supporting a door frame, a bolt of sufficient length for effective support by the door while extended, and that is compatible with existing door hardware.

SUMMARY

The present invention is directed to a deadbolt mechanism that satisfies this need. The mechanism comprises an elongated cylindrical bolt, means for guiding the bolt in the door between extended and retracted positions, a spindle unit having a cam for selectively engaging a transverse arcuate depression in the bolt, the cam being rotatable between an engaged position securing the bolt in the extended position and a released position permitting movement of the bolt, and a handle on the bolt for moving the bolt between the extended and retracted positions. The cam secures the bolt, but is not required to move the bolt. When the cam is in the released position, the bolt can slide freely while supported in the door on both sides of the spindle unit. Therefore, neither the length of the bolt nor its stroke must be limited by the securing device. Consequently, the present invention provides a long deadbolt having a long stroke for greater structural integrity and security as compared with conventional deadbolt locks.

Preferably the bolt is biased toward the extended position and the handle can be detented in the retracted position against the biasing means, conveniently keeping the bolt retracted when it is desired to keep the door unlocked. Preferably the bolt includes a second transverse arcuate depression for engaging the cam in the retracted position, positively holding the bolt in the retracted position.

Preferably the spindle unit includes a lock cylinder for turning the cam by means of a key. Preferably the lock cylinder is accessible from one side of the door, and the spindle unit includes a thumbturn for rotating the cam from the opposite side of the door.

Preferably a stroke distance moved by the bolt between the extended position and the retracted position is at least approximately two times a cylindrical thickness of the bolt. Preferably the bolt has a length in excess of the stroke length by at least approximately four times the cylindrical thickness.

Preferably the bolt is capable of extending through a frame member of the door and into supporting structure therefor, the mechanism including a keeper plate for laterally reinforcing the supporting structure. Preferably the bolt is 0.7 to 1.0 inch in diameter, having a length of at least about 6.0 inches, a stroke of about 2.0 inches, and the cam rotates on an axis located about $2\frac{3}{8}$ inches from the edge of the door for compatibility with standard door hardware.

The present invention provides a method for equipping a door and its frame with a deadbolt mechanism, the method comprising the steps of:

(a) providing a mechanism comprising:
  (i) a cylindrical bolt having at least one transverse arcuate depression therein;
  (ii) a lock cylinder unit having a rotatable spindle and a cam attached to the spindle for selectively engaging the depression in the bolt; and
  (iii) a handle member for moving the latch bolt when the cam is disengaged from the bolt;
(b) forming a guide hole in the door perpendicular to an edge of the door for receiving the bolt;
(c) forming a chamber in the door for the cam, the chamber intersecting the guide hole and opening to at least one side of the door;
(d) inserting the bolt into the first clearance hole;
(e) mounting the lock cylinder against one side of the door with the cam positioned within the chamber and the spindle located on an axis perpendicular to the side of the door for permitting the cam to engage the depression for securing the bolt in the extended position; and
(f) fastening the handle member to the bolt, the handle member protruding the side of the door for moving the bolt between the extended and the retracted positions.

The present invention can be used to replace existing conventional deadbolt lock mechanisms because the spindle unit can be mounted at a standard backset distance from the edge of the door. A standard face plate and clearance hole configuration for the bolt can be modified to accommodate the bolt of the present invention by extending the clearance hole sufficiently deep into the door. A standard clearance hole for lock cylinder hardware intersecting the bolt clearance hole can be extended to one side of the bolt clearance hole for providing clearance for the cam. When the spindle unit is mounted against one side of the door, the enlarged clearance hole is covered. A conventional engagement hole in the frame for the bolt can be extended into supporting structure of the frame for receiving the extended bolt.

DRAWINGS

These and other features, aspects, and advantages of the present invention will become better understood with reference to the following description, appended claims, and accompanying drawings where:

DESCRIPTION

Figure 1:
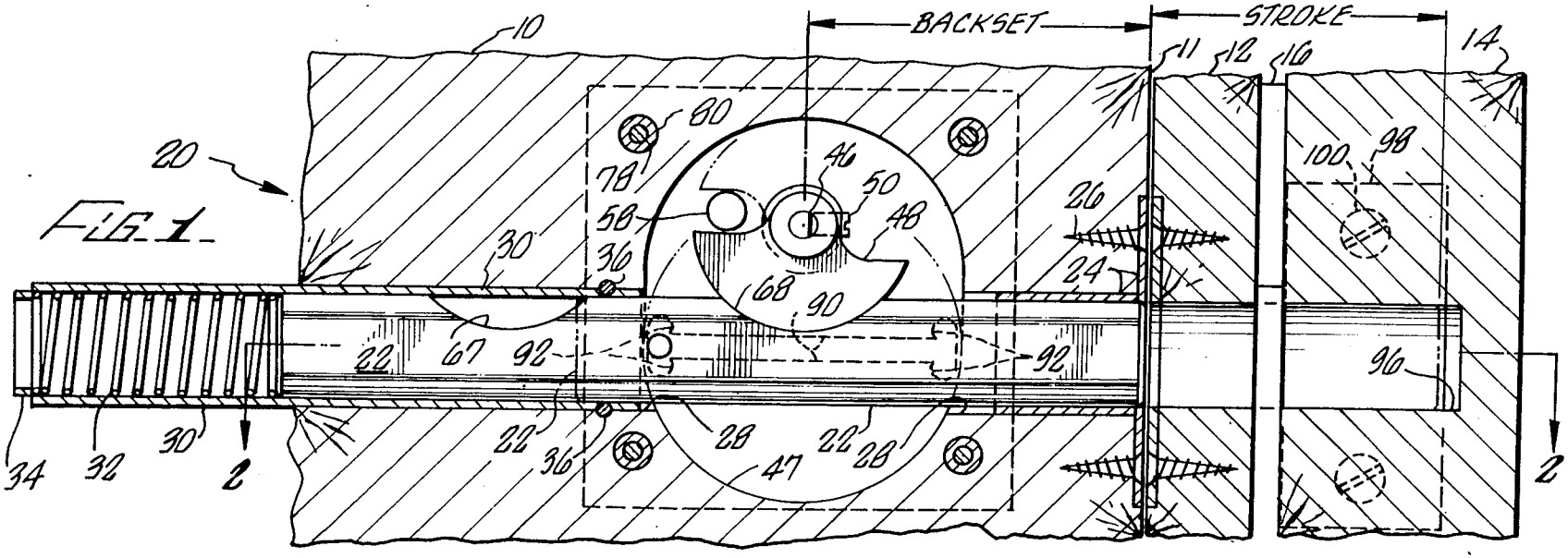
FIG. 1 is a fragmentary sectional elevational view of a door equipped with a deadbolt lock according to the present invention, the door being in a closed position within a frame.
Figures 2, 3, 4, 6:
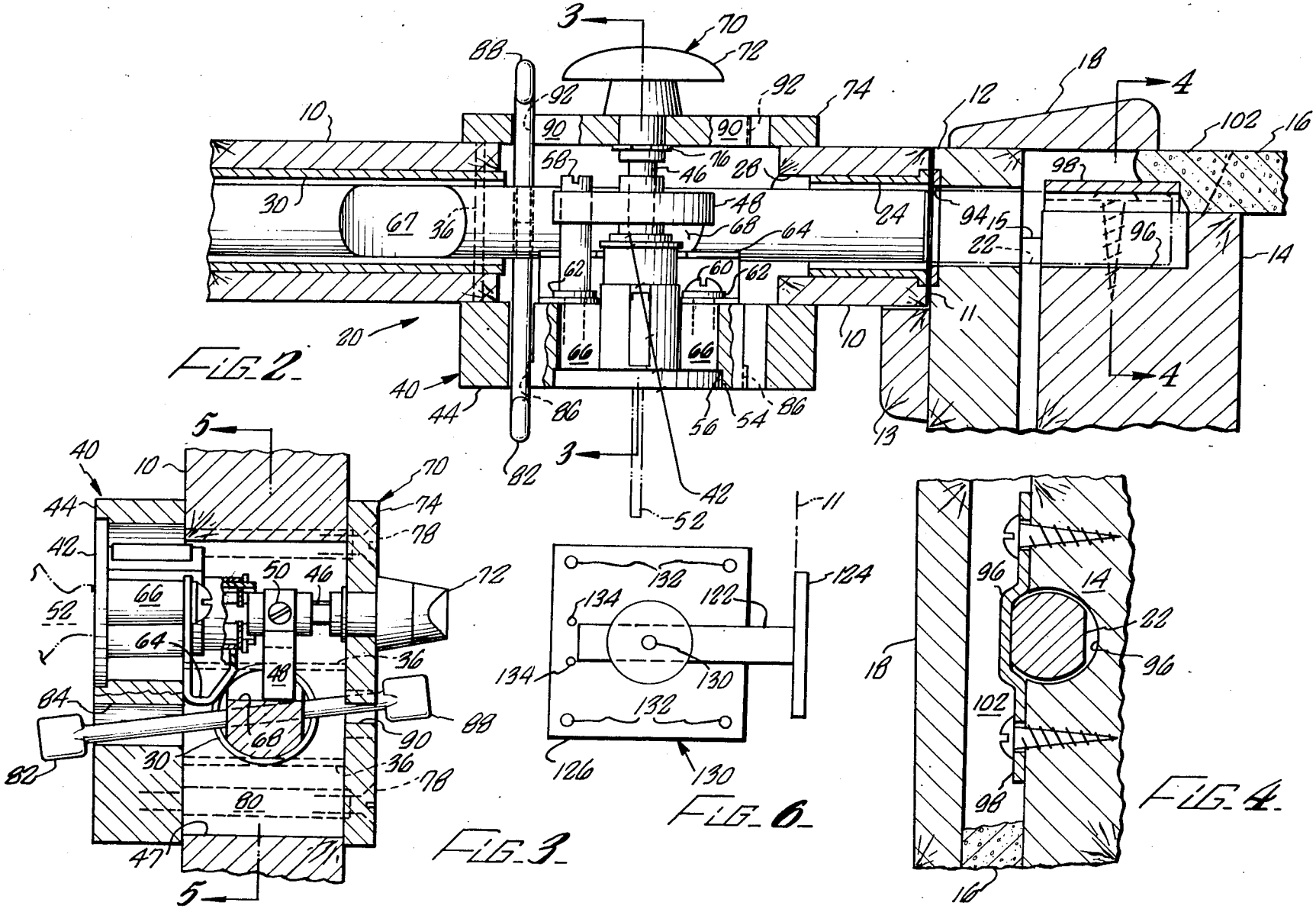
FIG. 2 is a fragmentary sectional plan view of the lock of FIG. 1 taken along line 2—2 in FIG. 1.
FIG. 3 is a fragmentary sectional elevational view of the lock of FIG. 1 taken along line 3—3 in FIG. 2.
FIG. 4 is a fragmentary sectional elevational view of the lock of FIG. 1 taken along line 4—4 in FIG. 2.
FIG. 6 is a side elevational view of a jig facilitating installation of the lock of FIG. 1.

The present invention is directed to a deadbolt lock mechanism for residential and commercial buildings. With reference to FIGS. 1 and 2, a conventional hinged door 10 having an edge 11 closes within a frame 12 against a stop 13, the stop 13 being fastened to the frame 12. The frame 12 is supported by a stud 14, or other structure, with a shim 15 therebetween for alignment purposes. A wall member 16 covers the stud 14, and a trim molding 18, attached to the frame 12, extends over the wall member 16.

With reference to FIGS. 1–5, a deadbolt mechanism 20 according to the present invention includes an elongated cylindrical bolt 22 slidingly supported in the door 10. A faceplate guide 24 supports the bolt proximate to the edge 11 of the door 10, the faceplate guide 24 being mortised flush with the edge 11 and fastened to the door 10 by a pair of plate screws 26 in a conventional manner. The faceplate guide 24 extends into a guide hole 28, the guide hole 28 extending about 6 to 8 inches edgewise into the door.

A guide tube 30 is positioned within the guide hole 28 for supporting the bolt 22 within the door 10. A bolt spring 32 is compressively positioned between a dog member 34 on the guide tube 30 and the bolt 22 for axially biasing the bolt 22 toward the frame 12. A pair of retainer pins 36, extending flush with both sides of the door 10, tangentially intersect the guide tube 30 for axially retaining the guide tube 30 within the guide hole 28. Thus the guide tube 30 provides solid support for both the bolt 22 and the bolt spring 32 within the door 10, even when the door 10 is of "hollow-core" construction.

A cylinder unit 40 is located against one side of the door 10 proximate to the bolt 22. The cylinder unit 40 includes a lock cylinder 42 protruding a cylinder block 44, the lock cylinder 42 having a spindle shaft 46 extending into a transverse chamber 47 in the door 10. A cam 48 is fastened to the spindle shaft 46 by a set screw 50, the cam 48 being rotatable by means of a key 52 engaging the lock cylinder 42. The lock cylinder 42 is of conventional construction, slightly modified for mounting within the cylinder block 44. Conventional lock cylinders suitable for use within the present invention are available from Kwikset Division, Emhart Hardware Group, Anaheim, Calif. The lock cylinder 42 has a flange 54 engaging a counterbore 56 in the cylinder block 44. A stop screw 58 and a guard screw 60, each with a washer 62, clamp the cylinder block 44 against the flange 54. A guardplate 64, further described below, is clamped between the washers 62 and the cylinder block 44. The stop screw 58 and the guard screw 60 each engage existing threaded holes in a pair of bosses 66 of the lock cylinder 44. The bosses 66 are modified by machining them flush with the cylinder block 44. The stop screw 58 limits the rotation of the cam 48 to approximately half a revolution as further described below.

A transverse arcuate depression, designated first depression 67, is formed in the bolt 22 for engaging the cam 48, securing the bolt 22 in a position extending from the edge 11 of the door 10. Preferably an additional transverse arcuate depression, designated second depression 68, is formed in the bolt 22 for engaging the cam 48 when the bolt 22 is approximately flush with the edge 11 of the door 10. Thus the bolt 22 can be selectively secured in extended and retracted positions corresponding to engagement of the cam 48 with the first depression 67 and the second depression 68 respectively. The second depression 68 is axially located on the bolt 22 for defining a predetermined "backset" distance between the spindle shaft 46 and the edge 11 of the door 10. The distance between the first depression 67 and the second depression 68 defines a "stroke" length by which the bolt 22 can extend from the edge 11 of the door 10.

A thumbturn assembly 70 is positioned against the door 10 opposite the cylinder block 44. The thumbturn assembly 70 includes a thumbturn 72, rotatably mounted in a clamp plate 74, the thumbturn 72 being coupled to the spindle shaft 46 for turning the cam 48. The thumbturn 72 is retained axially within the clamp plate 74 by a thumbturn retainer 76.

The clamp plate 74 is fastened to the cylinder block 44 by means of a plurality of clamp screws 78 protruding the clamp plate 74 and threadingly engaging corresponding standoffs 80, the standoffs 80 being rigidly fastened to the cylinder block 44 and extending through the door 10. Preferably the standoffs 80 extend a short distance into the clamp plate 74 for accurately registering the thumbturn 72 with the lock cylinder 42. Thus the cylinder unit 40 and the thumbturn assembly 70 are rigidly clamped to opposite sides of the door 10.

A first handle 82, rigidly attached to the bolt 22, extends through a block slot 84 in the cylinder block 44 for moving the bolt 22 between the extended and retracted positions when the cam 48 is rotated out of engagement with the bolt 22. When the bolt 22 is in the retracted position, the first handle 82 can be shifted vertically for engaging a block detent 86 in the cylinder block 44, rotating the bolt 22 slightly on its axis. The bolt spring 32, biasing the bolt 22 toward the extended position, maintains the first handle 82 in engagement with the block detent 86. Thus the bolt 22 is conveniently maintained in the retracted position without requiring the cam 48 to be in engagement with the second depression 68. Additional block detents 86 are provided at each end, above and below the block slot 84 for permitting reversible assembly of the cylinder unit 40.

Correspondingly, a second handle 88 protrudes a plate slot 90 in the clamp plate 74 for moving the bolt 22 between the extended and retracted positions. When the bolt 22 is in the retracted position, the second handle 88 can be moved vertically into engagement with one of four plate detents 92 for holding the bolt 22 in the retracted position against the bolt spring 32, the first handle 82 and the second handle 88 simultaneously engaging the corresponding block detent 86 and plate detent 92.

A strike plate 94 is mortised flush with the frame 12 and fastened thereto by a pair of the plate screws 26 for receiving the bolt 22. A jamb hole 96 extends behind the strike plate 94 completely through the frame 12 and into the stud 14 to a depth accommodating the stroke of the bolt 22. Typically, the jamb hole 96 is proximate to or breaks through a side of the stud 14 into the wall member 16. In these typical situations, a keeper plate 98 is preferably fastened against the stud 14 by a plurality of keeper screws 100 for laterally retaining the bolt 22 within the stud 14. The trim molding 18 can be removed and a portion of the wall member 16 can be broken away for facilitating installation of the keeper plate 98. Subsequently, a wall patch 102 can be formed over the keeper plate 98, and the trim molding 18 can be replaced.

As shown in FIG. 4, the keeper plate 98 is formed to have a slightly arched or low-profile hat-section configuration. This configuration can be altered according to the lateral position of the bolt 22 in the stud 14. For example, the configuration shown in the drawings corresponds to a door 10 having a thickness of $1\frac{3}{8}$ inches and a wall member 16 having a thickness of $\frac{1}{2}$ inch, the door 10 being flush with the wall member 16 and the bolt 22 being centrally located in the door 10. In the case of a $1\frac{3}{4}$ inch door and a $\frac{1}{2}$ inch thick wall member, the keeper plate 98 can be flat.

In operation, the door can be unlocked by rotating the cam 48 counterclockwise (as viewed in FIG. 1) against the stop screw 58, then retracting the bolt 22 from the frame 12. The cam may be rotated by inserting and turning the key 52 in the lock cylinder 42, or by turning the thumbturn 72, depending on the location of the operator. The lock cylinder 42 incorporates one-half turn of backlash in a conventional manner for permitting rotation of the cam 48 by the thumbturn 72 when the lock cylinder 42 is in a locked condition. The bolt is retracted by means of the first handle 82 or the second handle 88, then rotated on its axis until at least one of the handles 82 or 88 engages the corresponding block detent 86 or plate detent 92. The cam 48 may then be rotated in the opposite direction against the stop screw 58, engaging the second depression 68 for preventing inadvertent extension.

When closed, the door may be locked by rotating the cam 48 counterclockwise (as viewed in FIG. 1) against the stop screw 58 and releasing the first handle 82 and the second handle 88 from the corresponding block detent 86 and plate detent 92. The bolt 22 is then driven by the bolt spring 32 into the frame 12 and the stud 14. If necessary, the bolt 22 can be moved into full engagement with the frame 12 by means of the first handle 82 or the second handle 88. Once engaged, the bolt 22 is locked in the extended position by opposite rotation of the cam 48 as described above.

In a preferred configuration of the present invention, the bolt 22 has a conventional three-quarter inch diameter, flat-sided cross-sectional shape about 0.6 inch wide for use engaging a standard strike plate 94. The bolt 22 is about six inches long, the transverse arcuate depressions 67 and 68 being spaced apart on the bolt 22 by about two inches, the depression 68 being located at a standard backset distance of two and three-eighth inches from one end of the bolt 22.

Thus the bolt 22 advantageously has a stroke of more than 1.5 inches for engaging the stud 14, a distance corresponding to two times the cylindrical thickness of the bolt. This is beyond the reach of conventional deadbolt lock mechanisms that have a stroke of only about one inch. The present invention provides a stroke in excess of two times the thickness of the bolt, the bolt reaching into the door 10 a distance more than four times the thickness of the bolt 22 in the extended position. In fact, the bolt 22 is supported in the door 10 on opposite sides of the cavity 47, even in the extended position. Thus the bolt 22 has a supported length of approximately four inches in the door 10 when extended two inches into the frame 12 for preventing the bolt 22 from being torn out of the door 12.

Further, the cylinder unit 40 and the thumbturn assembly 70, being rigidly clamped to opposite sides of the door 12, add to the structural integrity of the door 12 by preventing the opposite sides of the door 12 from becoming separated when the bolt 22 is subjected to loading.

The use of the cam 48 in the present invention advantageously provides a bolt 22 having a length limited only by the depth of the guide hole 28, the bolt 22 having a stroke limited only by the length of the block slot 84 and/or the plate slot 90. Thus the stroke is not limited by the lock cylinder 42 and the cam 48 that secures the bolt 22.

The guard plate 64 extends between the cylinder block 44 and the cam 48 from a location proximate the block slot 84 for preventing unauthorized access to the cam 48 through the block slot 84 and the chamber 47. Thus a foreign object extending into the block slot 84 is shielded from the cam 48, maintaining the security of the deadbolt mechanism 20.

The present invention is compatible with existing door hardware in that the mechanism 20 is easy to install in place of the existing hardware, or in a new door that has provisions for standard hardware. Thus, the transverse cavity 47, originally a circular hole, is elongated to one side of the guide hole 28 for accommodating the cam 48, as shown in FIG. 1. The guide hole 28 is also extended beyond the cavity 47, opposite the edge 11, to a total depth of about eight inches, for accommodating the guide tube 30.

Figure 5:
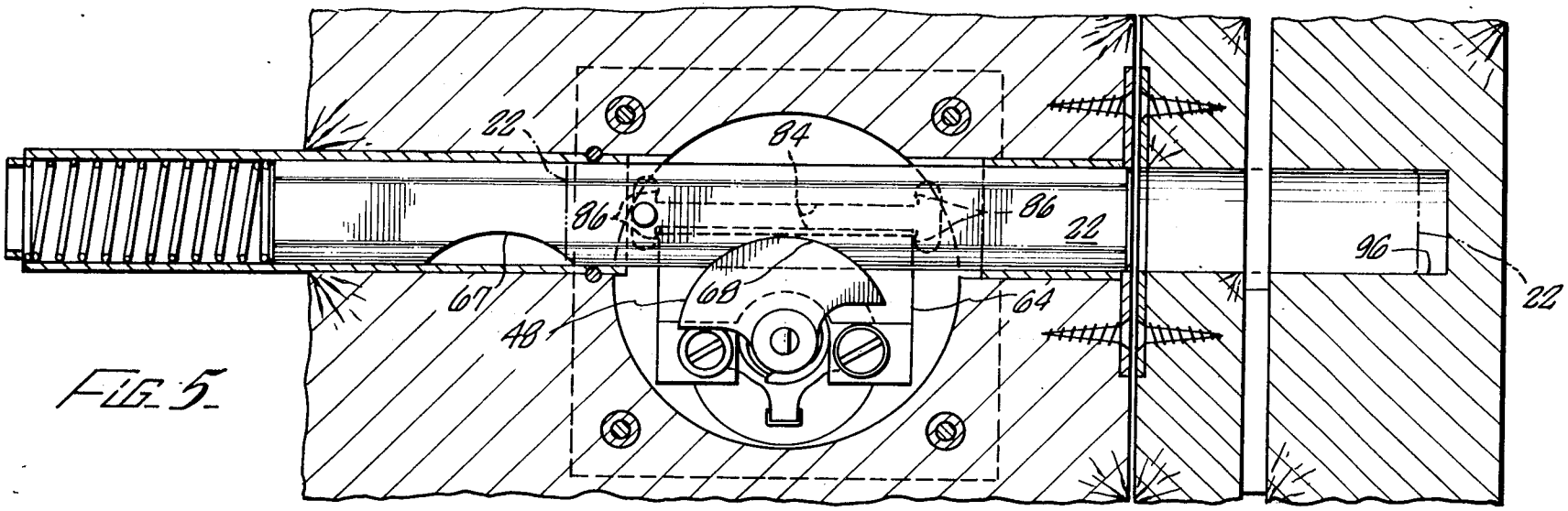
FIG. 5 is a fragmentary sectional elevational view of the lock of FIG. 1 taken along line 5—5 in FIG. 3.

When the cavity 47 is not required to be compatible with existing hardware, it can be formed as a circular hole of about 2.5 inches diameter, offset toward the cam 48 by about 0.5 inches from the center of the guide hole 28, as shown in FIG. 5.

With reference to FIG. 6, a drill jig 120 can be provided for installation of the cylinder unit 40. The drill jig 120 comprises a plug bar 122 for inserting into the guide hole 28, the plug bar 122 having a stop plate 124 for registering against the edge 11 of the door 10. The drill jig 120 also includes a jig plate 126 having a boss 128 through which the plug bar 122 is insertable. An alignment pin 130 is insertable through the jig plate 126 and the plug bar 122 for locating the jig plate axially on the plug bar 122. Thus the jig plate 126 can be located in a fixed position against one side of the door 10 as defined by the location of the guide hole 28 and the edge 11 of the door 10.

Preferably the plug bar 122 is laterally moveable with respect to the jig plate 126 when the plug bar 122 engages the boss 12 for use with doors of varient thicknesses.

A plurality of standoff holes 132 are provided in the jig plate 126 for transfer-drilling into the door 10, thus defining the locations for the standoffs 80 of the cylinder unit 40. Similarly, a pair of retainer pin holes 134 are provided in the jig plate 126 for locating the retainer pins 36 in the door 10.

Although the present invention has been described in considerable detail with regard to certain versions thereof, other versions are possible. For example, the spindle shaft 46 can intersect the bolt 22, the cam 48 operating in a lengthwise slot within the bolt, and the handles can be displaced axially on the bolt to one side of the slot. Therefore, the spirit and scope of the appended claims should not be limited to the description of the version contained herein.

What is claimed is:

1. A deadbolt mechanism for a door having first and second opposed sides, the mechanism comprising:

(a) an elongated cylindrical bolt having a first transverse arcuate depression therein;

(b) means for guiding the bolt in the door between the first and second sides, the bolt being moveable from an extended position to a retracted position;

(c) a spindle unit having a cam for selectively engaging the first depression, the cam being rotatable between an engaged position securing the bolt in the extended position, and a released position permitting movement of the bolt; and (d) handle means on the bolt for moving the bolt between the extended and retracted positions, the handle means protruding at least one side of the door.

2. The deadbolt mechanism of claim 1 including means for biasing the bolt toward the extended position.

3. The deadbolt mechanism of claim 2 wherein the handle means is rigidly affixed to the bolt, the bolt being capable of rotating in the guide means, the mechanism further comprising means for selectively engaging the handle means by rotating the bolt for holding the bolt in the retracted position against the biasing means.

4. The deadbolt mechanism of claim 1 including a second transverse arcuate depression in the bolt for engagement by the cam for retaining the bolt in the retracted position.

5. The deadbolt mechanism of claim 1 wherein the spindle unit includes a lock cylinder for rotating the cam by means of a key.

6. The deadbolt mechanism of claim 1 wherein the spindle unit includes a thumbturn for rotating the cam.

7. The deadbolt mechanism of claim 5 wherein the spindle unit includes backlash means for permitting rotational movement of the cam between the engaged position and the released position without requiring rotation of the lock cylinder and shaft means for rotating the cam from the opposite side of the door from the lock cylinder.

8. The deadbolt mechanism of claim 1 wherein the bolt has a cylindrical thickness and the distance traveled by the bolt between the extended position and the retracted position is at least approximately two times the thickness.

9. The deadbolt mechanism of claim 1 wherein the bolt has a maximum transverse cylindrical thickness and the bolt has a length of at least approximately four times the thickness in excess of the distance between the extended and retracted positions.

10. The deadbolt mechanism of claim 1 including a keeper plate for securing the bolt laterally within the frame of the door, the keeper plate being adapted for mounting to supporting structure of the frame.

11. The deadbolt mechanism of claim 1 wherein the bolt has a diameter of from about 0.7 to about 1.0 inches and the distance traveled by the bolt between the extended position and the retrated position is about two inches.

12. The deadbolt mechanism of claim 11 wherein the cam rotates on an axis located about $2\frac{3}{8}$ inches from an edge of the door and the bolt has a length of at least about 6.0 inches, the bolt being supported on opposite sides of the spindle unit.

13. The deadbolt mechanism of claim 1 mounted in a door.

14. A method for equipping a door with a deadbolt mechanism, the door having first and second opposed sides and a closed position within a frame, the method comprising the steps of:

(a) providing a mechanism comprising:

(i) a cylindrical bolt having at least one transverse arcuate depression therein;

(ii) a lock cylinder unit having a rotatable spindle and a cam attached to the spindle for selectively engaging the depression in the bolt; and (iii) a handle member for moving the latch bolt when the cam is disengaged from the bolt;

(b) forming a guide hole in the door between the first and second sides thereof, the guide hole extending inwardly from an edge of the door for receiving the bolt;

(c) forming a chamber in the door for the cam, the chamber intersecting the guide hole and opening to at least the first side of the door;

(d) inserting the bolt into the guide hole;

(e) mounting the lock cylinder against the first side of the door with the cam positioned within the chamber and the spindle located on an axis perpendicular to the side of the door for permitting the cam to engage the depression for securing the bolt in the extended position; and (f) fastening the handle member to the bolt, the handle member protruding the side of the door for moving the bolt between the extended and the retracted positions.

15. The method of claim 14 wherein the frame is supported by a stud, the method comprising the additional steps of drilling a jamb hole through the frame and into the stud whereby the bolt extends into the stud when the door is closed and the cam is engaging the depression.

16. A method for equipping a door with a deadbolt mechanism, the door having an edge and first and second opposed sides, a transverse clearance hole, and a guide hole extending perpendicular from the edge intersecting the clearance hole, the door also having a closed position within a frame, the method comprising the steps of:

(a) providing a mechanism comprising:

(i) a cylindrical bolt having at least one transverse arcuate depression therein;
(ii) a lock cylinder unit having a rotatable spindle and a cam connected to the spindle for selectively engaging the depression in the bolt; and
(iii) a handle member for moving the latch bolt when the cam is disengaged from the bolt;

(b) extending the guide hole in the door opposite the clearance hole for receiving the bolt;
(c) inserting the bolt into the guide hole;
(d) mounting the lock cylinder against the first side of the door with the cam positioned within the clearance hole and the spindle located on an axis perpendicular to the side of the door for permitting the cam to engage the depression for securing the bolt in the extended position; and
(f) fastening the handle member to the bolt, the handle member protruding the side of the door for moving the bolt between the extended and the retracted positions.

17. The method of claim 16 comprising the further step of enlarging the clearance hole for permitting movement of the handle member within the clearance hole.

18. The deadbolt mechanism of claim 2 wherein the means for guiding the bolt comprises;
(a) a guide tube for mounting within the door, the guide tube having an open first end and a second end, the second end being at least partially closed for retaining the biasing means;
(b) a guide plate for mounting at the edge of the door in the line with the guide tube, the guide plate having an aperture for receiving the bolt; and
(c) means for securing the guide tube in the door apart from the guide plate.

19. A deadbolt lock mechanism for a door having first and second opposed sides, the lock mechanism comprising;
(a) an elongated cylindrical bolt having first and second transverse arcuate depressions therein, the first and second depressions being spaced apart on the bolt by a distance of at least about 1.5 inches;
(b) means for guiding the bolt in the door between the first and second sides, the bolt being moveable from an extended position to a retracted position, the guide means comprising:
(i) a guide tube for mounting within the door, the guide tube having an open first end and a second end, the second end being at least partially closed;
(ii) a guide plate for mounting at the edge of the door in line with the guide tube, the guide plate having an aperture for receiving the bolt; and
(iii) means for securing the guide tube in the door apart from the guide plate;

(c) means for biasing the bolt toward the extended position comprising a spring within the guide tube, the spring engaging the second end of the guide tube;
(d) a spindle unit for mounting against the first side of the door, the spindle unit comprising;
(i) a rotatably mounted cam having a first position wherein the bolt is free to move between the extended and retracted positions, and a second position for engaging the first or second arcuate depressions wherein the bolt is prevented from moving;
(ii) a rotatable lock cylinder for turning the cam by means of a key between the first and second positions, thereby selectively securing the bolt in the extended and retracted positions; and
(iii) backlash means for permitting rotational movement of the cam without requiring rotation of the lock cylinder;

(e) shaft means for mounting against the second side of the door, the shaft means being capable of rotating the cam between the first and second positions without requiring rotation of the lock cylinder;
(f) first and second handles for protruding the corresponding first and second sides of the door for moving the bolt between the extended and retracted positions; and
(g) means for selectively engaging at least one of the handles for holding the bolt in the retracted position without requiring the cam to be in engagement with the second depression.

20. The deadbolt mechanism of claim 19 wherein the securing means comprises a pin member extending from proximate the first-side of the door to proximate the second side of the door, the pin member tangentially intersecting the guide tube.

* * * * *